US005529873A

United States Patent [19]

Chiba et al.

[11] Patent Number: 5,529,873

[45] Date of Patent: Jun. 25, 1996

[54] TONER FOR DEVELOPING ELECTROSTATIC IMAGES AND PROCESS FOR PRODUCING TONER

[75] Inventors: Tatsuhiko Chiba, Kamakura; Takashige Kasuya, Soka; Tatsuya Nakamura, Tokyo; Makoto Kanbayashi, Kawasaki; Kazuyuki Miyano, Tokyo; Koji Inaba, Yokohama, all of Japan

[73] Assignee: Canon Kabushiki Kaisha, Tokyo, Japan

[21] Appl. No.: 229,222

[22] Filed: Apr. 18, 1994

[30] Foreign Application Priority Data

Apr. 20, 1993 [JP] Japan ..... 5-115249

[51] Int. Cl.[6] ..... G03G 9/00

[52] U.S. Cl. ..... 430/109; 430/110; 430/111; 430/137; 523/201; 523/202; 528/488; 528/491

[58] Field of Search ..... 430/137, 110, 430/111, 109; 524/275, 277; 523/201, 202; 528/488, 491

[56] References Cited

U.S. PATENT DOCUMENTS

| | | | |
|---|---|---|---|
| 2,297,691 | 10/1942 | Carlson | 430/55 |
| 4,788,122 | 11/1988 | Kawabe et al. | 430/137 |
| 5,116,712 | 5/1992 | Nakamura et al. | 430/106 |
| 5,130,220 | 7/1992 | Nakamura et al. | 430/109 |
| 5,204,204 | 4/1993 | Shintani et al. | 430/137 |
| 5,272,040 | 12/1993 | Nakasawa et al. | 430/110 |
| 5,275,901 | 1/1994 | Anno et al. | 430/110 |
| 5,300,386 | 4/1994 | Kanbayashi et al. | 430/99 |

FOREIGN PATENT DOCUMENTS

| | | |
|---|---|---|
| 0230041 | 7/1987 | European Pat. Off. . |
| 0376202 | 7/1990 | European Pat. Off. . |
| 0533172 | 3/1993 | European Pat. Off. . |
| 2161126 | 6/1972 | Germany . |
| 3918084 | 12/1989 | Germany . |
| 56-116042 | 9/1981 | Japan . |
| 56-116043 | 9/1981 | Japan . |
| 60-238846 | 11/1985 | Japan . |
| 62-273758 | 11/1990 | Japan . |

*Primary Examiner*—Tae Yoon

*Attorney, Agent, or Firm*—Fitzpatrick, Cella, Harper & Scinto

[57] ABSTRACT

A toner for developing electrostatic images which comprises a toner particle produced by polymerizing a polymerizable monomer composition, wherein the toner particle contains 0.1–9.0% by weight of a modified polyester resin having one or more monomer units selected from a group consisting of styrene type monomer, acrylic monomer, and methacrylic monomer 16–50% by weight of a wax having a melting point of 50°–95° C., and 0.01–5.0% by weight of a charge controlling agent;

the resin component of the toner particle has a weight average molecular weight of 5,000–45,000;

and the toner particle has water absorption of 300–5,000 ppm.

95 Claims, No Drawings

TONER FOR DEVELOPING ELECTROSTATIC IMAGES AND PROCESS FOR PRODUCING TONER

BACKGROUND OF THE INVENTION

1. Field of the Invention

The present invention relates to a toner for developing electrostatic latent images and a process for producing the toner. More particularly, it relates to a toner for developing electrostatic images which comprises a toner particle produced by polymerizing a polymerizable monomer composition containing at least a polymerizable monomer, and a process for producing the toner comprising polymerizing a polymerizable monomer composition containing at least a polymerizable monomer, and obtaining the toner particle.

2. Related Background Art

There are many known techniques for electrophotography, as described, for example, in the specification of U.S. Pat. No. 2,297,691. In general, it is a process in which an electric latent image is formed on a photosensitive body utilizing a photoconductive material by various means, the latent image is developed by the use of a toner, and if necessary, the toner image is transferred onto a recording material such as paper, then it is fixed by heat, pressure or a solvent vapor and the like, to produce a copy. Various methods have been proposed so far, for developing the latent image by using the toner and for fixing the toner image, and each image formation process employs an appropriate method.

Recently, the electrophotographer has been required to provide a copy of higher image quality at a high speed.

Generally, a process referred to as pulverization has been known for producing a toner, in which a coloring material such as a dye and a pigment, and an additive such as a charge controlling agent are added to a thermoplastic resin, and melt-mixed to provide a homogeneous dispersion. The dispersion is pulverized and classified using a pulverizer and a classifier to produce a toner having a desired particle size.

With the toner produced by the pulverization process, there is a restriction in addition of a releasing agent such as a wax. That means, in order to assure the dispersibility of the releasing agent to be at a sufficient level, 1) a certain level of viscosity should be maintained at the kneading temperature with the resin, and 2) the content of the releasing material should be less than about 5 parts by weight, and so on. Due to these restrictions, the fixing capability of the toner produced by the pulverization process is limited.

On the contrary, a toner produced by suspension polymerization, i.e. a toner produced by polymerization method (hereinafter referred to as a polymerized toner) has no such limitation, and can encapsulate the wax and provides good fixing capability and offset resistance.

However, so far, the fixing capability of the polymerized toner has not been examined sufficiently from the perspective of high speed, high image quality, and full color copying and thus the features of the polymerized toner have not yet been fully drawn.

Particularly, since the polymerized toner of the conventional structure sometimes shows inferior blocking resistance when it contains a large amount of a wax, it is required to be improved. For example, in the specification of Japanese Patent Laid-Open Application No. 2-273758, acceleration of pseudo-capsulation is carried out. However, it has been disclosed that such pseudo-capsulation also requires further improvements when the toner contains a large amount of a wax.

In addition, for such encapsulation of a wax having a low melting point, it is required to increase the amount of the wax in order to improve the fixing capability. In such a case, it is difficult to encapsulate the wax completely, and even though the blocking characteristics can be retained at a certain level, the fluidity of the toner becomes insufficient.

As for the fluidity and the coagulation of the toner, a reactive polyester containing polymerized toner is proposed in the Japanese Patent Laid-Open Application No. 56-116042, and in the Japanese Patent Laid-Open Application No. 56-116043, and a saturated polyester containing polymerized toner is proposed in Japanese Patent Laid-Open Application No. 60-238846.

The toners produced by these methods have solved the problem of the fluidity to some extent. However, when a large amount of a wax is contained, the fluidity of the toner is still insufficient and the blocking resistance or granulation capability are lowered.

It is thought that the granulating system becomes unstable due to the inferior compatibility of the polyester resin with the wax and thus the content of the wax and that of the polyester in each toner particle fluctuate.

In order to decrease the particle size of the toner particle to improve the image quality, the polymerization process is more advantageous than the pulverization process from the view point of the toner yield and the energy required for the production. However, it was determined that polymerized toners are difficult to be sufficiently charged for providing high image quality under a stabilized condition. As the polymerized toner is granulated in an aqueous medium, the polar substance such as the charge controlling agent is localized on the surface. Due to this phenomenon, even when a charge controlling agent is added in a small amount, the toner particles are sometimes excessively charged. When the amount of the charge controlling agent is further decreased, it leads to a problem of delayed charge build-up. Also, when a charge controlling agent of weak charging capability is used, the build-up of the charge tends to become a problem.

SUMMARY OF THE INVENTION

An object of the present invention is to provide a toner for developing electrostatic images with which the above-mentioned problems have been solved, and a process for producing the toner.

Another object of the present invention is to provide a toner for developing electrostatic images having such fixing features that the meritorious characteristics of the polymerized toner are fully expressed even in high speed copying and full-color copying, having stabilized charging capability, as well as excellent blocking resistance characteristics, and a process for producing the toner.

A still further object of the present invention is to provide a toner for developing electrostatic images having particularly good fluidity in order to obtain an image having high image density, good narrow line reproducibility and highlight gradation, and a process for producing the toner.

Another object of the present invention is to provide a toner for developing electrostatic images, which shows good charge build-up in spite of its small content of the charge controlling agent, and which can steadily provide images from immediately after the start, as well as a process for producing the toner.

A still additional object of the present invention is to provide a toner for developing electrostatic images comprising a toner particle produced by polymerizing a polymerizable monomer composition which contains at least a polymerizable monomer, wherein the toner particle contains 0.1–9.0% by weight of a modified polyester resin having one or more kind of monomer units selected from a group consisting of styrene type monomer, acrylic monomer, and methacrylic monomer, 16–50% by weight of a wax having a melting point of 50°–95° C., and 0.01–5.0% by weight of a charge controlling agent;

the resin component of the toner particle has a weight average molecular weight of 5,000–45,000; and the toner particle has water absorption of 300–5,000 ppm.

A further object of the present invention is to provide a process for producing a toner comprising polymerizing a polymerizable monomer composition having 0.1–9.0% by weight of a modified polyester resin having at least a polymerizable monomer, and one or more kind of monomer units selected from a group consisting of styrene type monomer, acrylic monomer, and methacrylic monomer, 16–50% by weight of a wax having a melting point of 50°–95° C., and 0.01–5.0% by weight of a charge controlling agent, and obtaining a toner particle;

the obtained toner particle has water absorption of 300–5,000 ppm, and the resin component of the toner particle has a weight average molecular weight of 5,000–45,000.

DESCRIPTION OF THE PREFERRED EMBODIMENTS

As a result of the extensive research, the inventors have found that a toner shows good image quality and good blocking resistance when it contains a modified polyester resin having a specific monomer unit and a wax having a specific melting point, respectively in an amount of 0.1–9.0% by weight and 16–50% by weight to the weight of a polymerizable monomer of the polymerizable monomer composition. The reason is considered to be mainly because the modified polyester resin which becomes more hydrophilic than the binder component of the toner (the polymerizable monomer) by having the specific monomer unit, and the wax which is more hydrophobic, can be made appropriately compatible, while maintaining proper incompatibility in the monomer system, so that both the stabilized granulation and the encapsulation of the toner can be carried out in the presence of a large content of the wax.

That means, with the toner of the present invention, an oil droplet in the initial stage of the suspension polymerization is so stabilized that components in the monomer system are not separated, and as the polymerization proceeds, incompatibility increases and encapsulation occurs. Accordingly, the amount of the material per one toner particle becomes constant, and the particle size distribution as well as the toner charge distribution become sharp to improve the image quality. Besides, the effect of the wax, which is the cause of deterioration of the blocking feature, can be almost eliminated by improving the capsulation of the toner.

In addition, the modified polyester is localized on the surface due to the effect of the wax. The fluidity of the modified polyester itself is exercised to improve the fluidity of the polymerized toner and thus the image quality is improved.

The toner of the present invention preferably contains the modified polyester resin in an amount of 0.1–9.0% by weight, more preferably 1.0–8.0% by weight to the weight of a polymerizable monomer contained in a polymerizable monomer composition. When the content of the modified polyester resin is less than 0.1% by weight, it is insufficient for forming a polyester layer on the toner surface layer, and the fluidity of sufficient level cannot be obtained and the image quality becomes inferior. When the content of the modified polyester component exceeds 9.0% by weight, it produces a large amount of fine particles mainly consisting of the polyester component in the suspension, to broaden the particle size distribution.

The polyester part of the modified polyester resin of the present invention is produced by condensation polymerization of an acid monomer such as terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexane dicarboxylic acid, and trimellitic acid with a polyhydric alcohol monomer exemplified by an alkylene glycol such as ethylene glycol, diethylene glycol, triethylene glycol, 1,2-propylene glycol, 1,3-propylene glycol, 1,4-butane diol, neopentylglycol, 1,4 -bis(hydroxymethyl)cyclohexane and a polyalkylene glycol, bisphenol A, hydrogenated bisphenol, ethylene oxide adduct of bisphenol A, propylene oxide adduct of bisphenol A, glycerine, trimethylol propane and pentaerythritol.

The modified polyester resin is the polyester resin obtained by the above-mentioned condensation polymerization, which contains one or more monomer units selected from a group consisting of styrene type monomer, acrylic monomer and methacrylic monomer, as a modifying component.

The modified polyester resin is the polyester resin modified by ionic bonding or radical polymerization with styrene type, acrylic or methacrylic monomer or polymer. Accordingly, the modified polyester resin includes a graft-copolymer in which styrene type, acrylic or methacrylic monomer unit is bonded to the main chain of the polyester by radical bonding or a block-copolymer in which above-mentioned monomer unit is incorporated in the main chain of the polyester by radical bonding or ionic bonding.

As the styrene type monomer, the acrylic monomer and the methacrylic monomer used for modification of the polyester resin, any conventional monomers can be used, and the styrene type monomer includes, for example, styrene, o-methyl styrene, m-methyl styrene, p-methyl styrene, p-methoxy styrene, p-ethyl styrene, and the acrylic monomer includes, for example, acrylic esters such as methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate and phenyl acrylate, acrylonitrile and acrylamide and the methacrylic monomer includes, for example, methacrylic acid and methacrylic esters such as methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate as well as methacrylonitrile. The monomer unit for modifying the polyester resin can be formed by the use of one of these monomers, or by the combined use of two or more of these monomers.

When the rate of the modification in the modified polyester resin is in a preferable range of 0.05–48% by weight (more preferably 0.05–40% by weight, and still more preferably 0.1–20% by weight), the image quality is further improved. When the modification rate is below 0.05% by weight, the solubility in the polymerizable monomer composition containing the polymerizable monomer and the wax is decreased a little, which increases in the production of the fine particles and lowers of the fluidity, and the image quality tends to be degraded. When the modification rate exceeds 40% by weight, the solubility in the polymerizable monomer composition is increased too much for the polyester component to be present on the toner surface, thus both the charging capability and the fluidity tend to be lowered to result in low image quality.

These resins are generally polymeric, and have a strong influence on the fixing capability, but, when the weight average molecular weight of the resin component of the obtained toner particle is in a range of 5,000–45,000 (preferably 12,000–45,000), not only does it retain excellent fixing capability of the polymerized toner, but also it further expands the fixing region.

This is considered to occur because the modified polyester contributes not only to the fixing capability on the high temperature side as a polymer component but also to the adhesion capability with the transfer material such as paper.

When the average molecular weight of the resin component of the toner particle is below 5,000, the heat fusibility of the toner becomes too high, and it tends to cause high temperature offset, and when the average molecular weight of the resin component of the toner particle exceeds 45,000, the resin becomes too hard, and it not only tends to cause low temperature offset but also tends to lower the toner's color mixing capability.

According to the present invention, the desirable wax content to the toner particle is 16–50% by weight, preferably 16–40% by weight. When the wax content is below 16% by weight, not only the fixing characteristics are lowered, but also the granulating capability and image quality tend to be degraded. This is considered to occur because the small amount of the wax weakens the encapsulation capability of the surface layer polyester. Besides, when the wax is contained in an amount of more than 50% by weight to the toner, the encapsulation with the binder component is difficult to retain and the granulation capability as well as blocking resistance tend to be lowered.

The melting point of the wax is preferably 50°–90° C., more preferably 55°–80° C., due to its solubility in a monomer during the suspension polymerization. When the melting point of the wax is below 50° C., the toner particle has a liquid core under a high temperature environment, thus the toner particle tends to be easily broken, and when the melting point of the wax exceeds 90° C., the temperature required for the homogeneous wax dispersion in the monomer becomes close to the boiling point of the monomer, the production becomes difficult, and it becomes more difficult for the wax to be contained in a large amount in the toner particles as in the present invention.

The wax used in the present invention includes a polyalkylene type wax such as paraffin wax, polyolefin wax and Fischer-Tropsch wax; amide waxes; higher fatty acids; ester waxes; and the derivatives thereof or graft/block compounds thereof. Among these compounds, the polyalkylene type wax is especially preferable. More specifically, according to the present invention, among these waxes, those having the SP value of 10 or less are preferable, since it is required for the wax to keep compatibility with the polymerizable monomer, and to retain its hydrophobic property. The SP value is referred as the solubility parameter which shows the solubility of a material. Here, it is calculated according to the Fedors' method.

The inventors have also found that when the toner particle has water absorption of 300–5,000 ppm, preferably 320–2,000 ppm, and the charge controlling agent is contained in an amount of 0.01–5% by weight, preferably 0.01–3% by weight, to the toner, the toner of the present invention shows good charge build-up to provide stabilized images beginning immediately after the start. This is considered to occur because the water in the toner particle allows the easy movement of the generated charge, and that leads to good build-up of the charge. Since the build-up of the charge is good, only a trace amount of the charge controlling agent is required as described above, and this is especially advantageous for those toners including a color toner where the charge controlling agent might change the tint of the toner color.

When the water absorption of the toner particle is less than 300 ppm, the charge leak becomes too small and the image density is lowered especially in a low temperature and low humidity environment. Besides, when the water absorption amount of the toner particle exceeds 5,000 ppm, the charge leak becomes too great to cause toner scattering and fogging especially under high temperature and high humidity conditions.

When the amount of the charge controlling agent to the toner particle is below 0.01% by weight, the amount of the charge controlling agent in the whole toner becomes insufficient, thus satisfactory toner charging characteristics cannot be obtained, and the image density tends to be low, toner scattering or fogging easily occurs and the pigment dispersion becomes poor as well. When the amount of the charge controlling agent to the toner exceeds 5.0% by weight, the amount of the charge controlling agent present on the toner surface becomes too much, and the toner's insulation is lowered, and it greatly affects the image density under high temperature and high humidity conditions. In order to further improve the charge characteristics of the toner of the present invention, the charge controlling agent preferably satisfies the following conditions.

That means, according to the present invention, the toner particle and the charge controlling agent preferably satisfy the following equation $$2 \leqq x_1/x \leqq 100$$

more preferably satisfy the following equation $$5 \leqq x_1/x \leqq 50$$

(wherein, x is the ratio (weight %) of the charge controlling agent input for production to the weight of the polymerizable monomer in the polymerizable monomer composition), $x_1$ is the content (wt %) of the charge controlling agent in the outermost surface of the toner particle expressed in the weight ratio to the weight of the binding resin present in the outermost surface layer of the toner particle.

Here, the "outermost surface layer" refers to an area from the surface of the toner particle to a depth of less than 5 nm.

When the value $x_1/x$ is below 2, the amount of the charge controlling agent present on the surface of the toner particle is insufficient, the build-up of the charge is delayed, and when the value $x_1/x$ exceeds 100, the amount of the charge controlling agent present on the toner surface is too much, the charge controlling agent on the surface can be easily removed to cause sleeve contamination or drum contamination, and in the end, it facilitates the deterioration of the image during repeating use.

The measurement of the charge controlling agent in the outermost surface layer is carried out by using XPS (X-ray Photoelectron Spectroscopy). The molar concentrations of the constituent elements are obtained from the XPS measurement, and from the obtained data with the known composition formula of the constituents, the unknown molar ratio of the constituents is obtained by solving simultaneous equations, and the obtained molar ratio is multiplied with the molecular weight of the constituent and normalized to provide a mass percent of the constituent.

In the suspension polymerization, the viscosity of the polymerization system increases as the polymerization progresses, the radicals and the polymerizable monomers move with difficulty, and a large amount of the polymerizable monomer component tends to remain in the polymer. Particularly in the case of the suspension-polymerized toner, a large amount of a component which may affect the polymerization reaction such as a magnetic material, a charge controlling agent, a dye and a pigment (especially carbon black) exist in the polymerizable monomer system in addition to the polymerizable monomer; non-reacted polymerizable monomer tends to remain further more.

When a large amount of the polymerizable monomer as well as such components that work as a solvent to the binding resin, exist in the toner particle, not only the fluidity of the toner is lowered to degrade the image quality, but also the blocking resistance is lowered. In addition to those properties directly related as the toner, when an organic semiconductor is used as the photosensitive member, there are still other problems caused by the deterioration of the photosensitive body, such as memory ghost, or unfocused image in addition to the fusion of the toner on the photosensitive member drum. Apart from those problems concerning the performance of the product, there is still a problem such as a bad smell caused by evaporation of the polymerizable monomer component during fixing of images.

Due to the above-mentioned reasons, with the toner of the present invention, the image quality is further improved by decreasing the amount of the remaining polymerizable monomer present in the toner particle, and the amount of the polymerizable monomer remaining in the toner particle is preferably less than 1000 ppm, more preferably less than 500 ppm.

As a means to control the amount of the polymerizable monomer remaining in the toner particle at 1000 ppm or less, there can be used a known polymerizable monomer consumption accelerating means used for production of a binding resin by suspension polymerization process. For example, the means to eliminate the non-reacted polymerizable monomer includes a process to wash with an organic solvent of high volatility which does not dissolve the toner binding resin but dissolves the polymerizable monomer and/or an organic solvent component; a process to wash with an acid or an alkali; a process to add a foaming agent or a solvent component which does not dissolve the polymer to the polymer system so that the obtained toner is made porous to increase the areas from which the inner polymerizable monomer and/or an organic solvent component can evaporate; and a process to evaporate the polymerizable monomer and/or the organic solvent component under reduced pressure. Since there are difficulties, however, such that the toner components are eluted due to weakened toner encapsulation capability, and the selection of the solvent is difficult from the view point of the residual solvent, the most preferable is a process to evaporate the polymerizable monomer and/or the organic solvent component under reduced pressure.

In order to further improve the durability of the toner, indentations are preferably provided on the toner particle surface so that the slicing friction of the toner external additive of the toner is controlled.

As a polymerizable monomer to be used for producing a toner by polymerization, those already mentioned for modification of the polyester resin, such as styrene type monomer, acrylic esters, and methacrylic esters can be used; these are, for example, styrene type monomer such as styrene, o-methyl styrene, m-methyl styrene, p-methyl styrene, p-methoxy styrene and p-ethyl styrene; acrylic esters such as methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate and diethyl aminoethyl methacrylate; and other monomers such as acrylonitrile, methacrylonitrile and acrylamide. Among these monomers, styrene or a styrene derivative is preferably used alone, in mixture, or in mixture with another monomer, from the view point of the developing characteristics and the durability of the toner.

According to the present invention, a charge controlling agent is added in the toner particle in order to control the charging capability of the toner. However, as the toner particle of the present invention is negatively charged since the surface material is polyester, a negative charge controlling agent is preferably added to provide a negatively charged toner.

The negative charge controlling agent includes metal containing salicylic acid type compounds, metal containing mono-azo type dye compounds, styrene-acrylic acid copolymers, imidazole derivatives, styrene-methacrylic acid copolymers and (N,N'-diaryl urea derivatives).

In the dispersing medium used in the present invention, any appropriate stabilizing agent can be used. Examples include inorganic compounds such as calcium phosphate, magnesium phosphate, aluminium phosphate, zinc phosphate, calcium carbonate, magnesium carbonate, calcium hydroxide, magnesium hydroxide, aluminium hydroxide, calcium metasilicate, calcium sulfate, barium sulfate, bentonite, silica, and alumina. Organic compounds such as polyvinyl alcohol, gelatin, methyl cellulose, methyl hydroxy propyl cellulose, ethyl cellulose, sodium salt of carboxyl methyl cellulose, polyacrylic acid and its salt, and starch can also be used after being dispersed in water phase. The stabilizing agent is preferably used in an amount of 0.2–20 parts by weight to 100 parts by weight of a polymerizable monomer.

In order to finely disperse the stabilizing agent, 0.001–0.1 parts by weight of a surfactant to 100 parts by weight of a polymerizable monomer may be used. This is to accelerate the desired function of the above-mentioned dispersion stabilizer, and examples include sodium dodecyl benzene sulfate, sodium tetradecyl sulfate, sodium pentadecyl sulfate, sodium octyl sulfate, sodium oleate, sodium laurate, potassium stearate, and calcium oleate.

Among these dispersion stabilizers, calcium phosphate is advantageous since it can provide a toner with preferable particle size distribution, preferable toner shape and preferable toner internal structure.

Calcium phosphate can be used in a powder shape without any further processing, however, calcium phosphate prepared in water using such materials as sodium phosphate and calcium chloride, is rather preferable. In such a process, a very fine calcium phosphate can be obtained to provide a stable suspension, resulting in good granulation capability.

A polymerized toner which is used in the present invention can be obtained by the following procedure.

To a polymerizable monomer are added 0.1 to 9.0% by weight of a modified polyester resin having at least one monomer unit selected from the group consisting of a styrenic monomer, an acrylic monomer and a methacrylic monomer, 16 to 50% by weight of a wax having a melting point of 50° to 95° C. and 0.01 to 5.0% by weight of a charge controlling agent, and if necessary, other additives such as a colorant and a polymerization initiator are further added thereto. The mixture is then uniformly dissolved or dispersed by a mixing means such as a homogenizer or an ultrasonic dispersion device to form a polymerizable monomer composition. Next, this composition is added to an aqueous phase containing a dispersion stabilizer, and then dispersed by a usual stirrer, homomixer or homogenizer. Preferably, the stirring speed and the time are regulated so that each drop of the monomer may have a predetermined toner particle size of usually 30 μm or less, thereby making particles. Afterward, by the function of the dispersion stabilizer, a particle state is maintained, and stirring can be then carried out so as to prevent the precipitation and flotation of the particles. After completion of the polymerization reaction, the dispersion stabilizer is removed, and the produced toner particles are washed, collected by filtration, and then dried. In a suspension polymerization process, it is preferable that water is used as a dispersant in an amount of 300 to 3000 parts by weight with respect to 100 parts by weight of the monomer system.

In the above-mentioned process, the polymerization is carried out at a polymerization temperature of 40° C. or more, usually 50° to 90° C. At this time, as a technique for controlling the polymerization temperature, the temperature is preferably raised by 5° to 30° C. during the process of the polymerization.

In the present invention, examples of the polymerization initiator which can be used in the polymerization of the toner particle manufacturing process include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide and lauroyl peroxide. The amount of each polymerization initiator is preferably in the range of 0.5 to 20% by weight based on the weight of the polymerizable monomer.

Examples of the colorant which can be used in the present invention include carbon black, iron black, dyes such as C. I. Direct Red 1, C. I. Direct Red 4, C. I. Acid Red 1, C. I. Basic Red 1, C. I. Mordant Red 30, C. I. Direct Blue 1, C. I. Direct Blue 2, C. I. Acid Blue 9, C. I. Acid Blue 15, C. I. Basic Blue 3, C. I. Basic Blue 5, C. I. Mordant Blue 7, C. I. Direct Green 6, C. I. Basic Green 4 and C. I. Basic Green 6; and pigments such as yellow lead, Cadmium Yellow, mineral Fast Yellow, Navel Yellow, Naphthol Yellow S, Hansa Yellow G, Permanent Yellow NCG, Tartrazine Lake, Molybdenum Orange, Permanent Orange GTR, Benzidine Orange G, Cadmium Red, Permanent Red 4R, calcium salts of Watching Red, Brilliant Carmine 3B, Fast Violet B, Methyl Violet Lake, Prussian Blue, Cobalt Blue, Alkali Blue Lake, Victoria Blue Lake, quinacridone, Rhodamine Lake, Phthalocyanine Blue, Fast Sky Blue, Pigment Green B, Malachite Green Lake and Final Yellow Green.

In the present invention, in order to obtain the toner by the use of the polymerization process, it is necessary that much attention is paid to the polymerization disturbance by and aqueous phase migration of the colorant. It is preferable to carry out a surface modification, for example, a hydrophobic treatment with a substance having no polymerization disturbance. In particular, most of the dyes and carbon black show the polymerization disturbance, and care should be taken at the time of their use. An example of surface treatment process of the dye is to previously polymerize the polymerizable monomer in the presence of the dye, and then to add the obtain colored polymer to the monomer system. Furthermore, in addition to the above method, with regard to carbon black, a graft treatment may be carried out with a substance (e. g. polyorganosiloxane) which reacts with surface functional groups of carbon black. In the present invention, a magnetic material may be added, but this magnetic material is also preferably subjected to the surface treatment.

Examples of the additives which can be used for the purpose of imparting various characteristics in the present invention include the following materials, in addition to the hydrophobic inorganic oxide:

1) Fluidity-imparting agents: Carbon black and carbon fluoride.
2) Abrasive materials: Metal oxides (strontium titanate, cerium oxide, aluminum oxide, magnesium oxide and chromium oxide), a nitride (silicon nitride), a carbide (silicon carbide), and metallic salts (calcium sulfate, barium sulfate and calcium carbonate).
3) Lubricant: Fluorine-based resin powders (vinylidene fluoride and polytetrafluoroethylene), and metallic salts of fatty acids (zinc stearate and calcium stearate).
4) Charge controlling agents: Metallic oxides (tin oxide, titanium oxide, zinc oxide, silicon oxide and aluminum oxide), and carbon black.

These additives can be used in an amount of 0.1 to 10 parts by weight, preferably 0.1 to 5 parts by weight with respect to 100 parts by weight of the toner particles. These additives may be used singly or in combination of two or more thereof.

Next, measuring methods used in the present invention are described below.

(1) Measurement of Particle Distribution

As a measuring device, there is used Coulter Counter TA-II type (made by Coulter Electronics Inc.), and this counter is connected to a CX-1 personal computer (made by Canon Inc.) via an interface (Nikkaki Co., Ltd.) for outputting a number average distribution and a volume average distribution. The electrolyte is an 1% aqueous NaCl solution prepared from first-grade sodium chloride.

As the measuring procedure, a surface active agent, preferably 0.1 to 5 ml of alkylbenzene sulfonate is added as a dispersant to 100 to 150 ml of the above-mentioned aqueous electrolyte, and 0.5 to 50 mg of a sample to be measured is further added. The electrolyte in which the sample has been suspended is subjected to a dispersion treatment for 1 to 3 minutes with an ultrasonic dispersion device, and the particle distribution of the particles having a diameter of 2 to 40 μm is then measured using the above-mentioned Coulter Counter TA-II with an 100 μm aperture to obtain the volume average distribution and the number average distribution.

From the thus obtained volume average distribution and number average distribution, a weight average particle diameter $D_4$ is calculated.

(2) Measurement of Melting Point of Wax

The melting point of a wax is measured at a temperature rise rate of 10° C./minute by the use of DSC- 7 (made by Perkin-Elmer), and the peak top temperature indicating the maximum endothermic on a DSC curve at the first temperature rise is regarded as the melting point of the wax.

(3) Measurement of Amount of Remaining Polymerizable Monomer in Toner Particles

For polymerization conversion rate, a solution was prepared by adding a polymerization inhibitor to 1 g of a suspension, and then dissolving it in 4 ml of tetrahydrofuran (THF). Amounts of remaining polymerizable monomers and a remaining organic solvent in the toner particles were determined by analyzing a solution obtained by dissolving 0.2 g of the toner in 4 ml of THF by gas chromatography in accordance with an internal standard method under the following conditions.

G. C. Conditions

Measuring apparatus: Shimadzu GC-15A (with a capillary column)

Carrier: $N_2$, 2 kg/cm$^2$, 50 ml/min Split ratio=1:60, and Linear speed=30 mm/sec.

Column: ULBON HR-1, 50 m×0.25 mm

Temperature rise: 50° C. hold for 5 min
↓ 10° C./min
100° C.
↓ 20° C./min
200° C. hold Amount of sample: 2 μl Marker material: toluene (4) Measurement of Water Absorption of Toner Particles First, 0.5±0.1 g of a sample is allowed to stand under circumstances of 23° C. and 60% RH for 3 days or more, and the water absorption of the toner particles is then measured by the use of a trace moisture measuring device (AQ-6, made by Hiranuma Sangyo Co., Ltd.) (a titration agent= Hydranalaqualite RS). The heating of the sample is carried out by means of an automatic water vaporizing device (SE-24, made by Hiranuma Sangyo Co., Ltd.) (set to 110° C., $N_2$ gas=0.25 liter/min).

(5) Measurement of Molecular Weight Distribution of Resin Component

As standards, the following commercially available standard polystyrenes (made by Tosoh Co., Ltd.) are used, and the 15 standard polystyrenes are classified into 4 groups as follows.

| | | | | |
|---|---|---|---|---|
| (1) | $8.42 \times 10^6$ | $7.06 \times 10^5$ | $3.79 \times 10^4$ | $2.98 \times 10^3$ |
| (2) | $4.48 \times 10^6$ | $3.35 \times 10^5$ | $1.96 \times 10^4$ | $8.7 \times 10^3$ |
| (3) | $2.89 \times 10^6$ | $1.9 \times 10^5$ | $9.1 \times 10^3$ | $5.0 \times 10^2$ |
| (4) | $1.09 \times 10^6$ | $9.64 \times 10^4$ | $5.57 \times 10^3$ | |

About 3 mg (one microspatula) of the sample of each group is placed in a 30 ml sample vial and 15 ml of THF is added, and the sample is then allowed to stand at room temperature for 4 hours. Next, the solution is filtered through a membrane filter (0.50 μm, made by Tosoh Co., Ltd.) to prepare the control samples.

Unknown Sample 60 mg of a sample is weighed and placed in a sample vial, and 15 ml of THF is then added. As extraction conditions, the sample solution is allowed to stand at room temperature for 24 hours, with shaking every 30 minutes for the first 3 hours. Insolubles are precipitated by means of centrifugal separation (5000 rpm for 20 minutes), and the resulting supernatant is filtered through a membrane filter (0.50 μm, made by Tosoh Co., Ltd.) to prepare the sample.

GPC

Measurement was made using 150 C ALC/GPC made by Waters Inc. under the following conditions.

1. Solvent: THF (made by Kishida Chemicals Co., Ltd., special grade)
2. Column: Seven-serial columns of Shodex A-801, A-802, A-803, A-804, A-805, A-806, A-807 (made by Showa Denko K. K.)
3. Temperature: 40° C.
4. Flow rate: 1.0 ml/min
5. Injection amount: 1.0 ml
6. Detector: RI The weight average molecular weight of the resin component of the toner particles of the present invention is calculated from the GPC chromatogram obtained by the above mentioned method by eliminating peaks or shoulders corresponding to the components other than the resin component, e.g. wax component.

The toner for electrostatic image development of the present invention comprises toner particles manufactured by polymerizing a polymerizable monomer composition containing at least a polymerizable monomer, and the toner particles contain a modified polyester resin having a specific monomer unit, a wax having a melting point of 50° to 95° C. and a charge controlling agent in specific amounts, respectively. Moreover, the resin component of the toner particles has a weight average molecular weight of 5000 to 45000, and the toner has a water absorbing capacity of 300 to 5000 ppm. Therefore, the modified polyester and the wax can be suitably compatibilized, maintaining non-compatibility in a monomer system, whereby the stable particle formation properties and the encapsulating properties of the toner containing a large amount of the wax are consistent with each other. In consequence, the toner particles have excellent fixing properties, stable charging properties, and blocking resistance and excellent fluidity to give improved image quality. Therefore, an image can be obtained which has a high image density, a good fine line reproducibility and an excellent highlight gradation. In addition, even if the content of the charge controlling agent is low, the start-up of the charging is excellent, so that the stable image can be obtained from immediately after the start.

EXAMPLES

Next, the present invention will be described in detail on the basis of examples. In the following blends, part(s) means part(s) by weight, unless otherwise specified.

Preparation Example 1 of Modified Polyester Resin 15 parts by weight of diethylhexyl acrylate and 15% of 1 part by weight of a 15% cobalt naphthenate-styrene solution were added to a polyester solution in which 300 parts by weight of a polyester resin having vinyl groups was dissolved in 1 liter of benzene, and the solution was then vigorously stirred at room temperature for 1 hour. Afterward, the solution was further stirred at 50° C. for 5 hours to carry out polymerization. Afterward, benzene and diethylhexyl acrylate were distilled off to obtain a modified polyester resin A. A modification ratio of the thus obtained modified polyester resin A was 3% by weight based on the weight increase of the polyester resin.

Preparation Example 2 of Modified Polyester Resin 100 parts by weight of styrene, 150 parts by weight of methyl methacrylate, 5 parts by weight of benzoyl peroxide and 2 parts by weight of α-methylstyrene dimer were stirred at 80° C. for 1 hour. To this reaction solution, slowly added dropwise was a polyester solution in which 200 parts by weight of a polyester resin having vinyl groups was dissolved in 1 liter of benzene, and the solution was then stirred for 6 hours, while a temperature of 80° C. was maintained, to carry out polymerization. Afterward, the styrene-methyl methacrylate polyester copolymer alone was separated to obtain a modified polyester resin B. The modification ratio of the thus obtained modified polyester resin B was 45% by weight in view of a weight increase of the polyester resin.

Preparation Example 3 of Modified Polyester Resin 20 parts by weight of styrene and 15% of 1 part by weight of a 15% cobalt naphthenate-styrene solution were added to a polyester solution in which 300 parts by weight of a polyester resin was dissolved in 1 liter of benzene, and the solution was then vigorously stirred at room temperature for 5 hours to carry out polymerization. Afterward, benzene and styrene were distilled off to obtain a modified polyester resin C. The modification ratio of the thus obtained modified polyester resin C was 3% by weight based on the weight increase of the polyester resin.

Preparation Example 4 of Modified Polyester Resin

The same procedure as in Preparation Example 1 of Modified Polyester Resin was carried out except that the amounts of styrene and a 15% cobalt naphthenate-styrene solution were changed into 60 parts by weight of styrene and 2 parts by weight of the 15% cobalt naphthenate-styrene solution and polymerization conditions were changed into 70° C. and 5 hours, to obtain a modified polyester resin D. The modification ratio of the thus obtained modified polyester resin D was 35% by weight based on the weight increase of the polyester resin.

Example 1

A 0.1M aqueous $Na_3PO_4$ solution and an 1M aqueous $CaCl_2$ solution were prepared. Next, 322 g of the 0.1M $Na_3PO_4$ and 850 g of ion exchanged water were thrown into a 2 liter flask of a TK system homomixer (made by Tokushukika Kogyo Co., Ltd.), and the solution was then stirred at 12000 rpm. Afterward, 48.4 g of the 1M aqueous $CaCl_2$ solution was slowly added thereto with the stirring of the above-mentioned homomixer heated up to 60 ° C. to obtain a dispersion medium containing $Ca_3(PO_4)_2$.

| | |
|---|---|
| Styrene | 180 g |
| n-butyl acrylate | 20 g |
| Paraffin wax (m.p. 70° C.) | 60 g |
| C. I. Pigment Blue 15:3 | 10 g |
| Modified polyester resin A | 10 g |
| Di-tert-butylsalicylic acid metallic compound | 1 g |

Of the above-mentioned components, the modified polyester resin A, the C. I. Pigment Blue 15:3, a di-tert-butylsalicylic acid chromium compound and 100 g of styrene were preliminarily dispersed by an attritor (Mitsui Miike Co., Ltd.) to prepare a colorant dispersion.

Next, all of the remaining components were added to the prepared colorant dispersion, and the solution was then heated up to 70° C., followed by dissolving and dispersing to form a polymerizable monomer mixture. Furthermore, 10 g of 2,2'-azobis(2,4 -dimethylvaleronitrile) and 1 g of 2,2'-azobisisobutylate were added as initiators and then dissolved, while 70° C. was maintained, to prepare a polymerizable monomer composition.

This polymerizable monomer composition was thrown into the dispersion medium prepared in the 2 liter flask of the homomixer. The solution was stirred at 70° C. for 20 minutes at 10,000 rpm by the use of the TK homomixer in a nitrogen atmosphere to form a granular polymerizable monomer composition. Afterward, reaction was carried out at 70° C. for 6 hours, while the solution was stirred by paddle stirring blades, and then polymerization was carried out at 90° C. for 10 hours.

After completion of the reaction, the resulting suspension was cooled, and hydrochloric acid was then added to dissolve $Ca_3(PO_4)_2$, followed by filtering, washing with water and drying, to obtain polymerized toner particles having a sharp particle diameter distribution and a weight average diameter of 8.2 μm. These toner particles were degassed at 45° C. under a reduced pressure of 50 mmHg for 12 hours. At this point of time, the amount of the residual polymerizable monomer in the toner particles, i.e., the content, was 150 ppm.

The molecular weight distribution of the resin component of the toner particles and the water absorption of the toner particles were 25000 and 630 ppm respectively.

Next, 0.7 part of a hydrophobic silica having a specific surface area of 200 $m^2/g$ determined by BET method was outwardly added to 100 parts of the obtained toner particles. This silica-added toner exerted an excellent performance in a blocking test at 55° C. for 7 days. Then, 93 parts of a ferrite carrier coated with an acrylic resin was mixed with 7 parts of the above toner outwardly added with silica to produce a developing agent.

By the use of this developing agent and a modified commercially available color copying machine (CLC-500, made by Canon Inc.), a durability test (running test) of 20000 sheets was carried out. As developing conditions, a development contrast was 220 V under circumstances of 23° C. and 65% RH. As a result, images were stably obtained with an image density of 1.3 or more, no fogging, a very high resolution and excellent fixation.

Furthermore, a similar test was made under circumstances of 15° C. and 10% RH, and as a result, similar good results were obtained.

Comparative Example 1

All the same procedure as in Example 1 was repeated except that among the components in Example 1, 30 g of modified polyester A was used, so that toner particles having a weight average particle diameter of 9.1 μm were obtained.

However, a large amount of a fine particles was formed, and consequently a particle diameter distribution was inconveniently broad.

By the use of the obtained toner particles, a developing agent was prepared in the same manner as in Example 1, and an image was developed with this developing agent. In this case, a density of the image was 1.4 or more, but a good deal of fogging occurred and the fixing temperature range became narrow.

Comparative Example 2

All the same procedure as in Example 1 was repeated except that the amount of a paraffin wax was 10 g, so that toner particles having a weight average particle diameter of 7.2 μm were obtained. The particle diameter distribution of the thus obtained toner particles was sharp, and developing properties of a developing agent formed therefrom were also good. However, its fixing temperature range was narrow.

Comparative Example 3

All the same procedure as in Example 1 was repeated except that the amount of a di-tert-butylsalicylic acid metallic compound was 15 g, so that toner particles having a weight average particle diameter of 6.1 μm were obtained. The obtained toner particles contained a lot of fine particles. A developing agent was prepared from the obtained toner particles in the same manner as in Example 1, and images were formed. In this case, fogging occurred and with the repetition of the running test, the image density was lowered.

Comparative Example 4

All the same procedure as in Example 1 was repeated except that the amount of 2,2'-azobis(2,4-dimethylvaleronitrile) as an initiator was 5 g, and the amount of a modified polyester was 30 g, so that toner particles having a weight average particle diameter of 8.1 μm were obtained. A developing agent was prepared from the obtained toner particles in the same manner as in Example 1, and images were formed. In this case, the amount of the modified polyester contained in the toner particles is large, the weight average molecular weight of the resin component of the obtained toner particles was as large as 67,000, and so the fixing temperature range was also narrow.

Comparative Example 5

All the same procedure as in Example 1 was repeated except that the amount of a modified polyester was 0.1 g and toner particles having a weight average particle diameter of 9.7 μm were obtained. A developing agent was prepared from the obtained toner particles in the same manner as in Example 1, and images were then formed out. In this case, the obtained toner had low blocking resistance, and after the durability test, the image had a low density and the image quality was also poor.

Example 2

The same procedure as in Example 1 was repeated except that the colorant component and the modified polyester A were changed as follows:

| | |
|---|---|
| Carbon black | 8 g |
| Modified polyester resin B | 10 g |

In this case, the weight average particle diameter of the toner particles was 8.1 μm, and the toner outwardly added with silica showed an excellent fluidity in a blocking test.

For the above-mentioned developing agent, a running test was carried out under the same conditions as in Example 1. As a result, the images were excellent in fixing properties, although the resolution was a little poor as compared with that of Example 1.

Example 3

The same procedure as in Example 1 was repeated except that the components in Example 1 were changed as follows, to obtain magnetic toner particles having a weight average particle diameter of 9.3 μm.

| | |
|---|---|
| Styrene | 180 g |
| Diethylhexyl acrylate | 20 g |
| Titanium coupling agent-treated magnetite | 100 g |
| Paraffin wax (m.p. 75° C.) | 35 g |
| Modified polyester resin C | 16 g |
| Di-tert-butyl butylsalicylic acid Zn compound | 1 g |

The weight average particle diameter of the obtained toner particles before outward addition was 9.3 μm, and the amount of a charge controlling agent for the toner surfaces was 8%. The obtained magnetic toner was subjected to a running test by the use of NP 2020 (made by Canon Inc.), and as a result, images were stably obtained which had an image density of 1.4 or more, no fogging and a very high resolving power.

Reference Example 4

The same procedure as in Example 1 was repeated to obtain toner particles except that a modified polyester resin A was replaced with a modified polyester resin D and C. I. Pigment Blue 15:3 had been made hydrophobic with a titanium coupling agent treatment. From the toner particles thus obtained, a developing agent was prepared. The water absorption of the obtained toner particles was 150 ppm.

The above-mentioned developing agent was subjected to a running test under the same conditions as in Example 1, and as a result, about the same results in Example 1 were obtained under circumstance of 23° C. and 60% RH, but slight fogging was observed, and image quality was slightly low under circumstance of 15° C. and 10% RH. Nevertheless, the developing agent had practically no problem. The image density was 1.1 or more. The results are shown in Table 2.

Example 5

The same procedure as in Example 1 was repeated except that instead of a paraffin wax used in Example 1 an ester-based wax (m.p.=75° C.) was used. A developing agent was then prepared therefrom. The water absorption of the obtained toner particles was 800 ppm.

The above-mentioned developing agent was subjected to a running test under the same conditions as in Example 1, and as a result, the similar results were obtained.

Tables 1 and 2 given below show the characteristics and the evaluation results of the toners described in Examples 1 to 5 and Comparative Examples 1 to 5.

TABLE 1

| | Physical Properties of Toners | | | | | | | |
|---|---|---|---|---|---|---|---|---|
| | Amount of modified polyester resin (wt %) | Amount of polyalkylene wax (wt %) | Amount of charge controlling agent (wt %) | Weight average molecular weight of resin component of toner particles (Mw) | Water absorption of toner particles (ppm) | Ratio of charge controlling agent on toner particle surface $X_1/X$ | Amount of remaining monomer in toner particles (ppm) | Number average distribution of toner particles (% of 5.04 μm or less) |
| Example 1 | 5.0 | 30.0 | 0.5 | 25000 | 15 | 15 | 150 | 28 |
| Example 2 | 5.0 | 30.0 | 0.5 | 34000 | 2000 | 16 | 230 | 37 |
| Example 3 | 8.0 | 17.5 | 0.5 | 36000 | 2600 | 6 | 360 | 17 |
| Example 4 | 5.0 | 30.0 | 0.5 | 25000 | 150 | 15 | 150 | 28 |
| Example 5 | 5.0 | 30.0 | 0.5 | 25000 | 800 | 15 | 150 | 28 |
| Comp. Ex. 1 | 15.0 | 30.0 | 0.5 | 40000 | 1300 | 10 | 180 | 53 |
| Comp. Ex. 2 | 5.0 | 5.0 | 0.5 | 28000 | 730 | 17 | 120 | 35 |
| Comp. Ex. 3 | 15.0 | 30.0 | 7.5 | 30000 | 1400 | 1.8 | 230 | 68 |
| Comp. Ex. 4 | 15.0 | 30.0 | 0.5 | 67000 | 600 | 11 | 500 | 39 |
| Comp. Ex. 5 | 0.05 | 30.0 | 0.5 | 33000 | 200 | 26 | 300 | 23 |

TABLE 2

| | | Fixing properties | | under circumstances of 23° C. and 65% RH | | | under circumstances of 15° C. and 10% RH | | |
|---|---|---|---|---|---|---|---|---|---|
| | Blocking Properties | Fixing at 140° C. | Fixing at 200° C. | Image density | Image quality | Fogging | Image density | Image quality | Fogging |
| Example 1 | ⊙ | Possible | Possible | 1.3 or more | ⊙ | Absent | 1.3 or more | ⊙ | Absent |
| Example 2 | ⊙ | Possible | Possible | 1.1 or more | ○ | Absent | 1.1 or more | ○ | Absent |
| Example 3 | ⊙ | Possible | Possible | 1.4 or more | ⊙ | Absent | 1.4 or more | ⊙ | Absent |
| Example 4 | ○ | Possible | Possible | 1.2 or more | ○ | Absent | 1.1 or more | *1 | *2 |
| Example 5 | ⊙ | Possible | Possible | 1.3 or more | ⊙ | Absent | 1.3 or more | ⊙ | Absent |
| Comp. Ex. 1 | ⊙ | Impossible | Possible | 1.4 or more | ○ | Present | 1.4 or more | ○ | Present |
| Comp. Ex. 2 | ⊙ | Impossible | Impossible | 1.3 or more | ⊙ | Absent | 1.3 or more | ⊙ | Absent |
| Comp. Ex. 3 | Δ | Possible | Possible | 1.2 or less | Δ | Present | 1.2 or more | Δ | Present |
| Comp. Ex. 4 | ⊙ | Impossible | Possible | 1.3 or more | ⊙ | Absent | 1.3 or more | ⊙ | Absent |
| Comp. Ex. 5 | X | Possible | Possible | 1.0 or less | X | Absent | 0.9 or more | X | Absent |

(Note): The blocking properties and the image quality were evaluated after storage at 55° C. for 1 week and after a durability test of 20000 sheets, respectively, on the basis of the 5 ranks of ⊙, ○, Δ, X, and XX.
The practicable level was ○ or more.
*1: As compared with the circumstances of 23° C. and 65% RH, the image quality was slightly low, but it was practically no problem.
*2: Fogging was slightly occurred, but it was practically acceptable.

What is claimed is:

1. A toner for developing electrostatic images comprising a toner particle produced by polymerizing in an aqueous medium a polymerizable monomer composition which contains at least a polymerizable monomer, a modified polyester resin having one or more monomer units selected from the group consisting of styrenic monomer, acrylic monomer and methacrylic monomer; a wax having a melting point of 50°–95° C.; and a charge controlling agent, wherein the toner particle contains a polymer produced by polymerization of the polymerizable monomer, 0.1–9.0% by weight of the modified polyester resin, 16–50% by weight of the wax and 0.01–5.0% by weight of the charge controlling agent; the resin component of the toner particle has a weight average molecular weight of 5,000–45,000;

and toner particle has water absorption of 300–5,000 ppm.

2. The toner according to claim 1, wherein the toner particle contains 1.0–8.0% by weight of the modified polyester resin, 16–40% by weight of the wax, and 0.01–3.0% by weight of the charge controlling agent.

3. The toner according to claim 1, wherein the resin component of the toner particle has a weight average molecular weight of 12,000–45,000.

4. The toner according to claim 1, wherein the wax has a melting point of 55°–80° C.

5. The toner according to claim 1, wherein the wax is selected from a group consisting of paraffin wax, polyolefin wax, Fischer-Tropsch wax, amide wax, higher fatty acid wax, ester wax, graft compounds thereof and block compounds thereof.

6. The toner according to claim 1, wherein the wax comprises a polyalkylene wax.

7. The toner according to claim 1, wherein the wax has SP value of 10 or less.

8. The toner according to claim 1, wherein the toner particle has water absorption of 320–2,000 ppm.

9. The toner according to claim 1, wherein the toner particle and the charge controlling agent satisfy the following equation $$2 \leqq x_1/x \leqq 100$$

wherein, x is the input ratio (wt %) of the charge controlling agent in the production (a weight ratio of the input amount of the charge controlling agent to the amount of the polymerizable monomer in the polymerizable monomer composition), $x_1$ is the content of the charge controlling agent present in the outermost surface layer of the toner particle (the ratio (wt %) of the charge controlling agent to the binding resin in the outermost surface layer of the toner particle).

10. The toner according to claim 1, wherein the toner particle and the charge controlling agent satisfy the following equation $$5 \leqq x_1/x \leqq 50$$

wherein, x is the input ratio (wt %) of the charge controlling agent in the production (a weight ratio of the input amount of the charge controlling agent to the amount of the polymerizable monomer in the polymerizable monomer composition), $x_1$ is the content of the charge controlling agent present in the outermost surface layer of the toner particle (the ratio (wt %) of the charge controlling agent to the binding resin in the outermost surface layer of the toner particle).

11. The toner according to claim 1, wherein the toner particle contains a polymerizable monomer remaining in the toner particle at 1000 ppm or less.

12. The toner according to claim 1, wherein the toner particle contains a polymerizable monomer remaining in the toner particle at 500 ppm or less.

13. The toner according to claim 1, wherein the polymerizable monomer comprises one or more monomers selected from a group consisting of styrenic monomer, acrylic monomer and methacrylic monomer.

14. The toner according to claim 1, wherein the polymerizable monomer comprises one or more monomers selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

15. The toner according to claim 1, wherein the polymerizable monomer comprises styrenic monomer; a mixture of styrenic monomers or a mixture of styrenic monomer and monomer other than styrenic monomer.

16. The toner according to claim 1, wherein the modified polyester resin has modification rate of 0.05–40% by weight.

17. The toner according to claim 1, wherein the modified polyester resin has modification rate of 0.1–20% by weight.

18. The toner according to claim 1, wherein the modified polyester resin has one or more monomer units selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2 -chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

19. The toner according to claim 1, wherein the modified polyester resin comprises (i) a graft copolymer in which styrenic, acrylic or methacrylic monomer unit is bonded to the main chain of the polyester by radical bonding, or (ii) a block copolymer in which styrenic, acrylic or methacrylic monomer unit is incorporated in the main chain of the polyester by radical bonding or ionic bonding.

20. A process for producing a toner comprising polymerizing in an aqueous medium a polymerizable monomer composition having at least a polymerizable monomer, 0.1–9.0% by weight of a modified polyester resin having one or more monomer units selected from a group consisting of styrenic monomer, acrylic monomer, and methacrylic monomer, 16–50% by weight of a wax having a melting point of 50°–95° C., and 0.01–5.0% by weight of a charge controlling agent; and obtaining a toner particle which has water absorption of 300–5,000 ppm, and a resin component having a weight average molecular weight average molecular weight of 5,000–45,000.

21. The process according to claim 20, wherein the polymerizable monomer contains at least a polymerizable monomer, 1.0–8.0% by weight of the modified polyester resin, 16–40% by weight of the wax, and 0.01–3.0% by weight of the charge controlling agent.

22. The process according to claim 20, wherein the resin component of the obtained toner particle has weight average molecular weight of 12,000–45,000.

23. The process according to claim 20, wherein the wax has a melting point of 55°–80° C.

24. The process according to claim 20, wherein the wax is selected from a group consisting of paraffin wax, polyolefin wax, Fischer-Tropsch wax, amide wax, higher fatty acid wax, ester wax, graft compounds thereof and block compounds thereof.

25. The process according to claim 20, wherein the wax comprises a polyalkylene wax.

26. The process according to claim 20, wherein the wax has SP value of 10 or less.

27. The process according to claim 20, wherein the toner particle has water absorption of 320–2,000 ppm.

28. The process according to claim 20, wherein the toner particle and the charge controlling agent satisfy the following equation $$2 \leqq x_1/x \leqq 100$$

wherein, x is the input ratio (wt %) of the charge controlling agent in the production (a weight ratio of the input amount of the charge controlling agent to the amount of the polymerizable monomer in the polymerizable monomer composition), $x_1$ is the content of the charge controlling agent present in the outermost surface layer of the toner particle (the ratio (wt %) of the charge controlling agent to the binding resin in the outermost surface layer of the toner particle).

29. The process according to claim 20, wherein the toner particle and the charge controlling agent satisfy the following equation $$5 \leqq x_1/x \leqq 50$$

wherein, x is the input ratio (wt %) of the charge controlling agent in the production (a weight ratio of the input amount of the charge controlling agent to the amount of the polymerizable monomer in the polymerizable monomer composition), $x_1$ is the content of the charge controlling agent present in the outermost surface layer of the toner particle (the ratio (wt %) of the charge controlling agent to the binding resin in the outermost surface layer of the toner particle).

30. The process according to claim 20, wherein the amount of the polymerizable monomer remaining in the toner particle is reduced to 1000 ppm or less by a method to remove a non-reacted polymerizable monomer from the toner particle.

31. The process according to claim 20, wherein a method to remove a non-reacted polymerizable monomer from the toner particle is selected form a group consisting of a process to wash with an organic solvent of high volatility which does not dissolves a toner binding resin but dissolves the polymerizable monomer and/or an organic solvent component; a process to wash with an acid or an alkali; a process to add a foaming agent or a solvent component which does not dissolve the polymer to the polymer system so that the obtained toner is made porous to increase an evaporation area of an inner polymeric monomer and/or an organic solvent component; and a process to evaporate the polymerizable monomer and/or organic solvent component under reduced pressure.

32. The process according to claim 20, wherein the amount of a polymerizable monomer remaining in the toner particle is reduced to 500 ppm or less by a method to remove a non-reacted polymerizable monomer from the toner particle.

33. The process according to claim 20, wherein the polymerizable monomer comprises one or more monomers selected from a group consisting of styrenic monomer, acrylic monomer and methacrylic monomer.

34. The process according to claim 20, wherein the polymerizable monomer comprises one or more monomers selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

35. The process according to claim 20, wherein the polymerizable monomer comprises styrenic monomer; a mixture of styrenic monomers; a mixture of styrenic monomer and monomer other than styrenic monomer.

36. The process according to claim 20, wherein the modified polyester resin has modification rate of 0.05–40% by weight.

37. The process according to claim 20, wherein the modified polyester resin has modification rate of 0.1–20% by weight.

38. The process according to claim 20, wherein the modified polyester resin has one or more monomer units selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

39. The process according to claim 20, wherein the modified polyester resin comprises (i) a graft copolymer in which styrenic, acrylic or methacrylic monomer unit is bonded, or (ii) a block copolymer in which styrenic, acrylic or methacrylic monomer unit is incorporated in the main chain of the polyester by radical bonding or ionic bonding.

40. The process according to claim 20, wherein the toner particle is obtained by suspension polymerization in which the polymerizable monomer composition is added to and dispersed in an aqueous medium to carry out polymerization reaction.

41. The toner according to claim 6, wherein the polyalkylene wax comprises paraffin wax, polyolefin wax or Fischer-Tropsch wax.

42. The process according to claim 25, wherein the polyalkylene wax comprises paraffin wax, polyolefin wax or Fischer-Tropsch wax.

43. A toner for developing electrostatic images comprising a toner particle produced by polymerizing in an aqueous medium a polymerizable monomer composition which contains at least a polymerizable monomer, a modified polyester resin having one or more monomer units selected from the group consisting of styrenic monomer, acrylic monomer and methacrylic monomer; a wax having a melting point of 50°–95° C.; and a charge controlling agent, wherein the toner particle contains a polymer produced by polymerization of the polymerizable monomer, 0.1–0.9% by weight of the modified polyester resin, 16–50% by weight of the wax and 0.01–5.0% by weight of the charge controlling agent; and the toner particle has water absorption of 300–5,000 ppm.

44. The toner according to claim 43, wherein the toner particle contains 1.0–8.0% by weight of the modified polyester resin, 16–40% by weight of the wax, and 0.01–3.0% by weight of the charge controlling agent.

45. The toner according to claim 43, wherein the resin component of the toner particle has a weight average molecular weight of 5000 or more.

46. The toner according to claim 43, wherein the wax has a melting point of 55°–80° C.

47. The toner according to claim 43, wherein the wax is selected from a group consisting of paraffin wax, polyolefin wax, Fischer-Tropsch wax, amide wax, higher fatty acid wax, ester wax, graft compounds thereof and block compounds thereof.

48. The toner according to claim 43, wherein the wax comprises a polyalkylene wax.

49. The toner according to claim 48, wherein polyalkylene wax comprises paraffin wax, polyolefin wax or Fischer-Tropsch wax.

50. The toner according to claim 43, wherein the wax has SP value of 10 or less.

51. The toner according to claim 43, wherein the toner particle has water absorption from 320–2000 ppm.

52. The toner according to claim 43, wherein the toner particle and the charge controlling agent satisfy the following equation:

$$2 \leqq x_1/x \leqq 100$$

wherein, x is the input ratio in wt % of the charge controlling agent, which said input ratio is a weight ratio of the input amount of the charge controlling agent to the amount of the polymerizable monomer in the polymerizable monomer composition, $x_1$ is the content of the charge controlling agent present in the outermost surface layer of the toner particle, which said content is the ratio in wt % of the charge controlling agent to the binding resin in the outermost surface layer of the toner particle.

53. The toner according to claim 43, wherein the toner particle and the charge controlling agent satisfy the following equation:

$$5 \leqq x_1/x \leqq 50$$

wherein, x is the input ratio in wt % of the charge controlling agent, which said input ratio is a weight ratio of the input amount of the charge controlling agent to the amount of the polymerizable monomer in the polymerizable monomer composition, $x_1$ is the content of the charge controlling agent present in the outermost surface layer of the toner particle, which said content is the ratio in wt % of the charge controlling agent of the binding resin in the outermost surface layer of the toner particle.

54. The toner according to claim 43, wherein the toner particle contains a polymerizable monomer remaining in the toner particle at 1000 ppm or less.

55. The toner according to claim 43, wherein the toner particle contains a polymerizable monomer remaining in the toner particle at 500 ppm or less.

56. The toner according to claim 43, wherein the polymerizable monomer comprises one or more monomers selected from a group consisting of styrenic monomer, acrylic monomer and methacrylic monomer.

57. The toner according to claim 43, wherein the polymerizable monomer comprises one or more monomers selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

58. The toner according to claim 43, wherein the polymerizable monomer comprises styrenic monomer; a mixture of styrenic monomers; or a mixture of styrenic monomer and monomer other than styrenic monomer.

59. The toner according to claim 43, wherein the modified polyester resin has modification rate of 0.05–40% by weight.

60. The toner according to claim 43, wherein the modified polyester resin has modification rate of 0.1–20% by weight.

61. The toner according to claim 43, wherein the modified polyester resin has one or more monomer units selected from a group consisting of styrene, o-methyl styrene, m-methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

62. The toner according to claim 43, wherein the modified polyester resin comprises (i) a graft copolymer in which styrenic, acrylic or methacrylic monomer unit is bonded to the main chain of the polyester by radical bonding, or (ii) a block copolymer in which styrenic, acrylic or methacrylic monomer unit is incorporated in the main chain of the polyester by radical bonding or ionic bonding.

63. A process for producing a toner comprising polymerizing in an aqueous medium a polymerizable monomer composition having at least a polymerizable monomer, 0.1–9.0% by weight of a modified polyester resin having one or more monomer units selected from a group consisting of styrenic monomer, acrylic monomer, and methacrylic monomer, 16–50% by weight of a wax having a melting point of 50°–95° C., and 0.01–5.0% by weight of a charge controlling agent; and obtaining a toner particle which has water absorption of 300–5,000 ppm.

64. The process according to claim 63, wherein the polymerizable monomer contains at least a polymerizable monomer, 1.0–8.0% by weight of the modified polyester resin, 16–40% by weight of the wax, and 0.01–3.0% by weight of the charge controlling agent.

65. The process according to claim 63, wherein the resin component of the obtained toner particle has weight average molecular weight of 5000 or more.

66. The process according to claim 63, wherein the wax has a melting point of 55° to 80° C.

67. The process according to claim 63, wherein the wax is selected from a group consisting of paraffin wax, polyolefin wax, Fischer-Tropsch wax, amide wax, higher fatty acid wax, ester wax, graft compounds thereof and block compounds thereof.

68. The process according to claim 63, wherein the wax comprises a polyalkylene wax.

69. The process according to claim 68, wherein the polyalkylene wax comprises paraffin wax, polyolefin wax or Fischer-Tropsch wax.

70. The process according to claim 63, wherein the wax has SP value of 10 or less.

71. The process according to claim 63, wherein the toner particle has water absorption of 320–2,000 ppm.

72. The process according to claim 63, wherein the toner particle and the charge controlling agent satisfy the following equation:

$$2 \leqq x_1/x \leqq 100$$

wherein, x is the input ratio in wt % of the charge controlling agent, which said input ratio is a weight ratio of the input amount of the charge controlling agent to the amount of the polymerizable monomer in the polymerizable monomer composition, $x_1$ is the content of the charge controlling agent present in the outermost surface layer of the toner particle, which said content is the ratio in wt % of the charge controlling agent to the binding resin in the outermost surface layer of the toner particle.

73. The process according to claim 63, wherein the toner particle and the charge controlling agent satisfy the following equation:

$$5 \leqq x_1/x \leqq 50$$

wherein, x is the input ratio in wt % of the charge controlling agent, which said input ratio is a weight ratio of the input amount of the charge controlling agent to the amount of the polymerizable monomer in the polymerizable monomer composition, $x_1$ is the content of the charge controlling agent present in the outermost surface layer of the toner particle, which said content is the ratio in wt % of the charge controlling agent to the binding resin in the outermost surface layer of the toner particle.

74. The process according to claim 63, wherein the amount of the polymerizable monomer remaining in the toner particle is reduced to 1000 ppm or less by a method to remove a non-reacted polymerizable monomer from the toner particle.

75. The process according to claim 63, wherein a method to remove a non-reacted polymerizable monomer from the toner particle is selected from a group consisting of a process to wash with an organic solvent of high volatility which does not dissolves a toner binding resin but dissolves the polymerizable monomer and/or an organic solvent component; a process to wash with an acid or an alkali; a process to add a foaming agent or a solvent component which does not dissolve the polymer to the polymer system so that the obtained toner is made porous to increase an evaporation of an inner polymerizable monomer and/or an organic solvent component; and a process to evaporate the polymerizable monomer and/or organic solvent component under reduced pressure.

76. The process according to claim 63, wherein the amount of a polymerizable monomer remaining in the toner particle is reduced to 500 ppm or less by a method to remove a non-reacted polymerizable monomer from the toner particle.

77. The process according to claim 63, wherein the polymerizable monomer comprises one or more monomers selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

78. The process according to claim 63, wherein the polymerizable monomer comprises styrenic monomer; a mixture of styrenic monomers; a mixture of styrenic monomer and monomer other than styrenic monomer.

79. The process according to claim 63, wherein the modified polyester resin has modification rate of 0.05–40% by weight.

80. The process according to claim 63, wherein the modified polyester resin has modification rate of 0.1–40% by weight.

81. The process according to claim 63, wherein the modified polyester resin has one or more monomers units selected from a group consisting of styrene, o-methyl styrene, m-methyl styrene, p-methyl styrene, p-methoxy styrene, p-ethyl styrene, methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, n-octyl methacrylate, dodecyl methacrylate, 2-ethyl hexyl methacrylate, stearyl methacrylate, phenyl methacrylate, dimethyl aminoethyl methacrylate, diethyl aminoethyl methacrylate, acrylonitrile, methacrylonitrile and acrylamide.

82. The process according to claim 63, wherein the modified polyester resin comprises (i) a graft copolymer in which styrenic, acrylic or methacrylic monomer unit is bonded, to the main chain of the polyester by radical bonding, or (ii) a block copolymer in which styrenic, acrylic or methacrylic monomer unit is incorporated in the main chain of the polyester by radical bonding or ionic bonding.

83. The process according to claim 63, wherein the toner particle is obtained by suspension polymerization in which the polymerizable monomer composition is added to and dispersed in an aqueous medium to carry out polymerization reaction.

84. The toner according to claim 1, including producing the toner particle by polymerizing in the aqueous medium the polymerizable monomer composition to form toner particles and thereafter reducing the amount of the polymerizable monomer remaining in the toner particle by removing unreacted polymerizable monomer from the toner particle, wherein the toner particle contains 1000 ppm or less unreacted polymerizable monomer.

85. The toner according to claim 84, including the step of removing unreacted polymerizable monomer from the toner particle by washing with an organic solvent of high volatility which does not dissolve a toner binding resin but dissolves at least one of the polymerizable monomer and an organic solvent component.

86. The toner of claim 84 including the step of removing unreacted polymerizable monomer from the toner particle by washing with an acid or an alkali.

87. The toner of claim 84 including the step of removing unreacted polymerizable monomer from the toner particle by adding a foaming agent or a solvent component which does not dissolve the polymer to the polymer system so that the toner is porosified to increase an evaporation area of at least one of an inner polymeric monomer and an organic solvent component.

88. The toner of claim 84 including the step of removing unreacted polymerizable monomer from the toner particle by evaporating at least one of the polymerizable monomer and organic solvent component under reduced pressure.

89. The toner according to claim 84, wherein the amount of polymerizable monomer remaining in the toner particle is reduced to 500 ppm or less by removing unreacted polymerizable monomer from the toner particle.

90. The toner according to claim 43, including producing the toner particle by polymerizing in the aqueous medium the polymerizable monomer composition to form toner particles and thereafter reducing the amount of the polymerizable monomer remaining in the toner particle by removing unreacted polymerizable monomer from the toner particle, wherein the toner particle contains 1000 ppm or less unreacted polymerizable monomer.

91. The toner according to claim 90, including the step of removing unreacted polymerizable monomer from the toner particle by washing with an organic solvent of high volatility which does not dissolve a toner binding resin but dissolves at least one of the polymerizable monomer and an organic solvent component.

92. The toner of claim 90 including the step of removing unreacted polymerizable monomer from the toner particle by washing with an acid or an alkali.

93. The toner of claim 90 including the step of removing unreacted polymerizable monomer from the toner particle by adding a foaming agent or a solvent component which does not dissolve the polymer to the polymer system so that the toner is porosified to increase an evaporation area of at least one of an inner polymeric monomer and an organic solvent component.

94. The toner of claim 90 including the step of removing unreacted polymerizable monomer from the toner particle by evaporating at least one of the polymerizable monomer and organic solvent component under reduced pressure.

95. The toner according to claim 90, wherein the amount of polymerizable monomer remaining in the toner particle is reduced to 500 ppm or less by removing unreacted polymerizable monomer from the toner particle.

* * * * *

UNITED STATES PATENT AND TRADEMARK OFFICE

CERTIFICATE OF CORRECTION

PATENT NO. : 5,529,873

DATED : June 25, 1996

INVENTOR(S) : TATSUHIKO CHIBA ET AL.

It is certified that error appears in the above-identified patent and that said Letters Patent is hereby corrected as shown below:

On the title page, item

[56] REFERENCES CITED

Foreign Patent Documents,
"62-273758 11/1990 Japan" should read
--2-273758 11/1990 Japan--.

COLUMN 6

Line 57, "$X_1$" should read --and $X_1$--.

COLUMN 10

Line 56, "an" should read --a--.
Line 67, "an" should read --a--.

COLUMN 14

Line 64, "procedure" should read --procedures-- and "was" should read --were--.

COLUMN 15

Line 1, "particles" should read --particle--.

COLUMN 17

Table 1, Example 1,
Under Column "Water absorption of toner particles,"
"15" should read --630--.

UNITED STATES PATENT AND TRADEMARK OFFICE

CERTIFICATE OF CORRECTION

PATENT NO. : 5,529,873

DATED : June 25, 1996

INVENTOR(S) : TATSUHIKO CHIBA ET AL.

It is certified that error appears in the above-identified patent and that said Letters Patent is hereby corrected as shown below:

COLUMN 18

Line 59, "and" should read --and the--.

COLUMN 19

Line 23, "$X_1$" should read --and $X_1$--.

COLUMN 20

Line 2, "monomer;" should read --monomer,--.
Line 6, "has" should read --has a--.
Line 7, "has" should read --has a--.
Line 39, "weight average molecular" (second occurrence) should be deleted.
Line 47, "has" should read --has a--.

COLUMN 21

Line 5, "$X_1$" should read --and $X_1$--.
Line 19, "$X_1$" should read --and $X_1$--.
Line 31, "form" should read --from--.
Line 33, "dissolves a" should read --dissolve a--.

COLUMN 22

Line 1, "monomers;" should read --monomers; or--.
Line 4, "has" should read --has a--.
Line 8, "has" should read --has a--.

UNITED STATES PATENT AND TRADEMARK OFFICE

CERTIFICATE OF CORRECTION

PATENT NO. : 5,529,873

DATED : June 25, 1996

INVENTOR(S) : TATSUHIKO CHIBA ET AL. Page 3 of 3

It is certified that error appears in the above-identified patent and that said Letters Patent is hereby corrected as shown below:

COLUMN 23

Line 3, "wherein" should read --wherein the--.
Line 19, "$X_1$" should read -- and $X_1$ --.
Line 35, "$X_1$" should read -- and $X_1$ --.

COLUMN 24

Line 2, "has" should read --has a--.
Line 4, "has" should read --has a--.

COLUMN 25

Line 1, "$X_1$" should read --and $X_1$--.
Line 16, "$X_1$" should read --and $X_1$--.
Line 29, "dissolves a" should read --dissolve a--.
Line 60, "monomers;" should read --monomers; or--.
Line 63, "has" should read --has a--.
Line 66, "has" should read --has a--.

Signed and Sealed this

Twenty-ninth Day of October 1996

*Attest:*

Bruce Lehman

BRUCE LEHMAN

*Attesting Officer*

*Commissioner of Patents and Trademarks*